US007631779B1

(12) United States Patent
Dean

(10) Patent No.: US 7,631,779 B1
(45) Date of Patent: Dec. 15, 2009

(54) BUCKET APPARATUS

(76) Inventor: Jeffrey P. Dean, 227 Valley View Rd., Bainbridge, NY (US) 13733

( * ) Notice: Subject to any disclaimer, the term of this patent is extended or adjusted under 35 U.S.C. 154(b) by 188 days.

(21) Appl. No.: 11/828,442

(22) Filed: Jul. 26, 2007

(51) Int. Cl.
*B65D 1/24* (2006.01)

(52) U.S. Cl. ..... 220/553; 220/555

(58) Field of Classification Search ..... 220/523, 220/553, 555, 773, 731, 734
See application file for complete search history.

(56) References Cited

U.S. PATENT DOCUMENTS

| | | | | | |
|---|---|---|---|---|---|
| RE11,302 | E | * | 1/1893 | Demming et al. | 220/553 |
| 896,619 | A | | 8/1908 | Burke | |
| 1,517,164 | A | * | 11/1924 | Lear | 15/264 |
| 1,997,362 | A | * | 4/1935 | Davis et al. | 220/553 |
| 2,321,981 | A | * | 6/1943 | Bowers | 211/85.21 |
| 2,470,463 | A | | 5/1949 | Botten | |
| 3,057,508 | A | * | 10/1962 | Kimbrough, Jr. | 220/318 |
| 4,403,483 | A | | 9/1983 | Lisalda | |
| 5,237,720 | A | | 8/1993 | Blase et al. | |
| D411,674 | S | | 6/1999 | Haley et al. | |

* cited by examiner

*Primary Examiner*—Harry A Grosso

(57) ABSTRACT

A bucket apparatus includes a housing that has a bottom wall and a peripheral wall that is attached to and extends upwardly from the bottom wall. The peripheral wall has an upper edge defining an opening into an interior of the housing. A dividing wall is positioned in the housing and divides the interior into a first section and a second section. The dividing wall is attached to the bottom wall. At least one handle is pivotally coupled to the housing.

9 Claims, 3 Drawing Sheets

BUCKET APPARATUS

BACKGROUND OF THE INVENTION

Field of the Invention

The present invention relates to bucket devices and more particularly pertains to a new bucket device for holding two different materials in a manner which retains separation of different materials when one is being poured from the bucket device.

SUMMARY OF THE INVENTION

The present invention meets the needs presented above by generally comprising a housing that has a bottom wall and a peripheral wall that is attached to and extends upwardly from the bottom wall. The peripheral wall has an upper edge defining an opening into an interior of the housing. A dividing wall is positioned in the housing and divides the interior into a first section and a second section. The dividing wall is attached to the bottom wall. At least one handle is pivotally coupled to the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
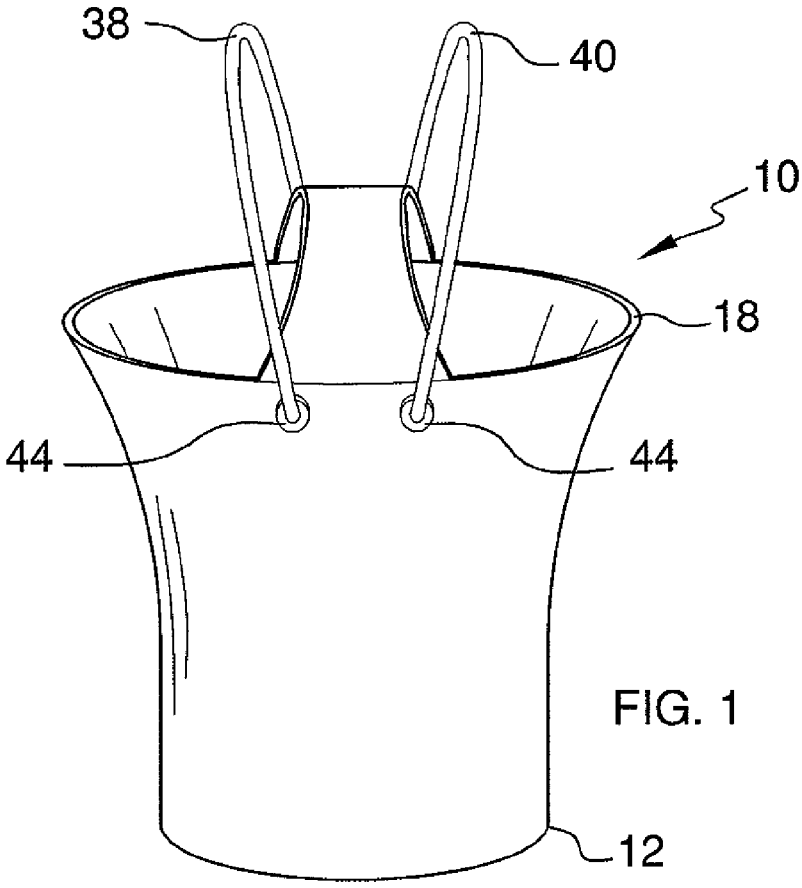
FIG. 1 is a perspective top view of a bucket apparatus according to the present invention.
Figure 2:
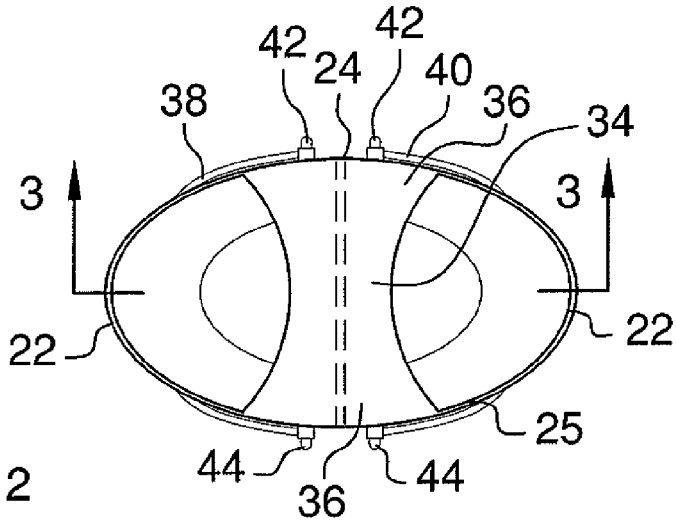
FIG. 2 is a top view of the present invention.
Figure 3:
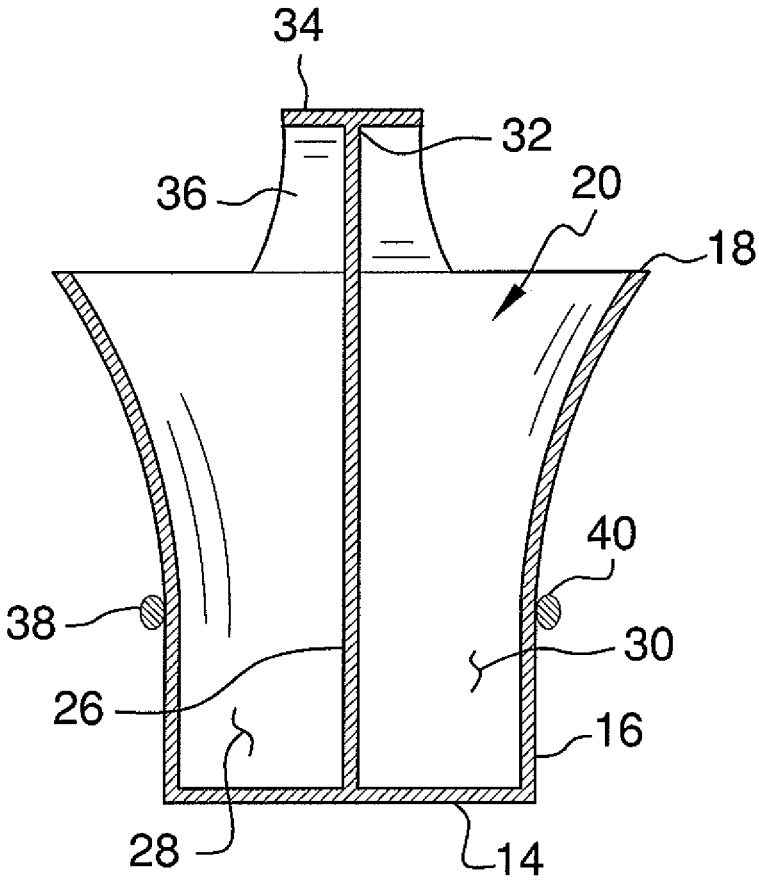
FIG. 3 is a cross-sectional view taken along line 3-3 of FIG. 2 of the present invention.
Figure 4:
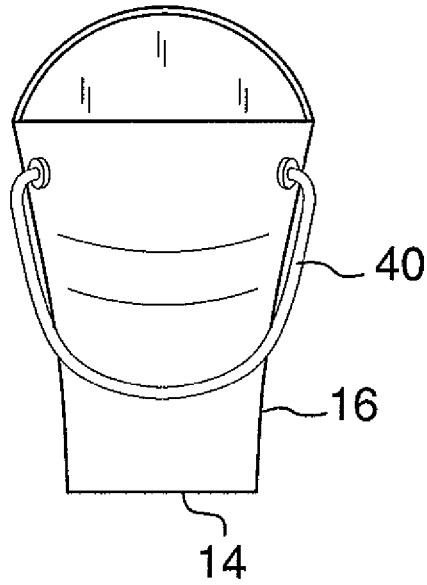
FIG. 4 is a side view of the present invention.
Figure 5:
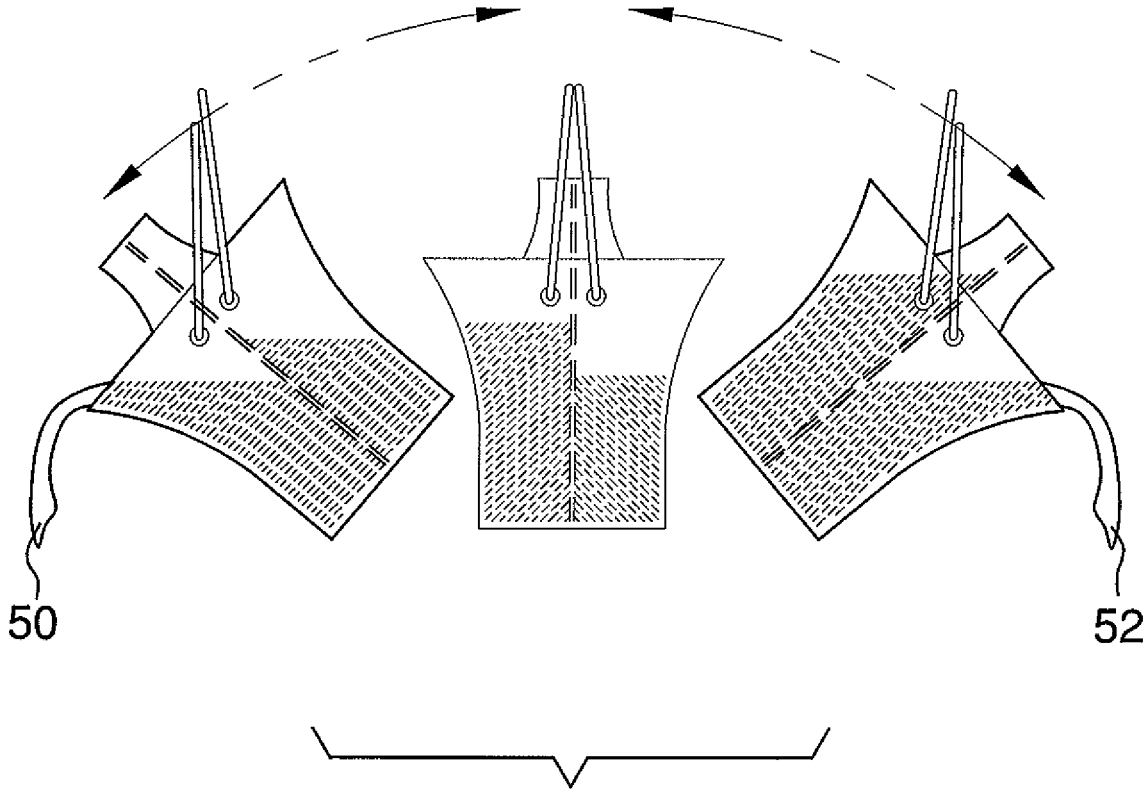
FIG. 5 is a side in-use view of the present invention.

With reference now to the drawings, and in particular to FIGS. 1 through 5 thereof, a new bucket device embodying the principles and concepts of the present invention and generally designated by the reference numeral 10 will be described.

As best illustrated in FIGS. 1 through 5, the bucket apparatus 10 generally comprises a housing 12 having a bottom wall 14 and a peripheral wall 16 is attached to and extends upwardly from the bottom wall 14. The peripheral wall 16 has an upper edge 18 defining an opening 20 into an interior of the housing 12. The bottom wall 14 has an oval shape. The peripheral wall 16 includes a pair of end walls 22 and a pair of lateral walls 24, 25. The lateral walls 24, 25 are longer than the end walls 22. The peripheral wall 16 flares outwardly from the bottom wall 14 to the upper edge 18.

A dividing wall 26 is positioned in the housing 12 and divides the interior of the housing 12 into a first section 28 and a second section 30 that are sealed apart from each other by the dividing wall 26. The dividing wall 26 is attached to the bottom wall 14 and extends between and is attached to the lateral walls 24, 25. The dividing wall 26 has a top edge 32 that is positioned above the upper edge 18 of the peripheral wall 16. The end walls 22 flare away form the dividing wall 26.

A top wall 34 is attached to the top edge 32 of the dividing wall 26. The top wall 34 extends partially over each of the first 28 and second 30 sections. Side walls 36 extend between the top wall 34 and the upper edge 18 of the peripheral wall 16. The side walls 36 and the top wall 34 define hoods of each of the first 28 and second 30 sections. The hoods prevent material from spilling from one section while material is being poured from the other section.

A pair of handles 38, 40 is provided. Each of the handles 38 is pivotally coupled to the housing 12. One of the handles 38 is attached to the first section 28 and one of the handles 40 is attached to the second section 30. Each of the handles 38, 40 includes a first end 42 and a second end 44. The handles 38, 40 are each approximately U-shaped. Each of the first ends 42 of the handles 38, 40 is attached to an outer surface of the first lateral wall 25 and the first ends 44 are positioned on opposite sides of the dividing wall 26 with respect to each other. The second ends 44 of the handles 38, 40 are attached to an outer surface of the second lateral wall 25 and are positioned on opposite sides of the dividing wall 26 with respect to each other.

In use, the bucket assembly 10 is used for holding materials wherein one material 50 may be positioned in the first section 28 and a second material 52 may be positioned in the second section 30. The shape of the peripheral wall 16 prevents the two materials 50, 52 from mixing while one is being dumped from the bucket assembly 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bucket assembly comprising:

a housing having a bottom wall and a peripheral wall being attached to and extending upwardly from said bottom wall, said peripheral wall having an upper edge defining an opening into an interior of said housing;

a dividing wall being positioned in said housing and dividing said interior into a first section and a second section, said dividing wall being attached to said bottom wall;

at least one handle being pivotally coupled to said housing; and said bottom wall having an oval shape, said peripheral wall including a pair of end walls and a pair of lateral walls, said lateral walls being longer than said end walls, said dividing wall extending between and being attached to said lateral walls, said peripheral wall flaring outwardly from said bottom wall to said upper edge, said dividing wall having a top edge, said top edge being positioned above said upper edge of said peripheral wall, a top wall is attached to said top edge of said dividing wall, said top wall extending partially over each of said first and second sections, side walls extending between said top wall and said upper edge of said peripheral wall, said side walls and said top wall defining hoods of each of said first and second sections.

2. The assembly according to claim 1, wherein said end walls flare away from said dividing wall.

3. The assembly according to claim 1, wherein said at least one handle includes a pair of handles, each of said handles being pivotally coupled to said housing, one of said handles being attached to said first section and one of said handles being attached to said second section, each of said handles including a first end and a second end, each of said handles being approximately U-shaped, each of said first ends of said handles being attached to an outer surface of a first of said lateral walls and being positioned on opposite sides of said dividing wall, each of said second ends of said handles being attached to an outer surface of a second one of said lateral walls and being positioned on opposite sides of said dividing wall.

4. A bucket assembly comprising:

a housing having a bottom wall and a peripheral wall being attached to and extending upwardly from said bottom wall, said peripheral wall having an upper edge defining an opening into an interior of said housing, said bottom wall having an oval shape, said peripheral wall including a pair of end walls and a pair of lateral walls, said lateral walls being longer than said end walls, said peripheral wall flaring outwardly from said bottom wall to said upper edge;

a dividing wall being positioned in said housing and dividing said interior into a first section and a second section, said dividing wall being attached to said bottom wall, said dividing wall extending between and being attached to said lateral walls, said dividing wall having a top edge, said top edge being positioned above said upper edge of said peripheral wall, said end walls flaring away from said dividing wall;

a top wall being attached to said top edge of said dividing wall, said top wall extending partially over each of said first and second sections, side walls extending between said top wall and said upper edge of said peripheral wall, said side walls and said top wall defining hoods of each of said first and second sections; and a pair of handles, each of said handles being pivotally coupled to said housing, one of said handles being attached to said first section and one of said handles being attached to said second section, each of said handles including a first end and a second end, each of said handles being approximately U-shaped, each of said first ends of said handles being attached to an outer surface of a first one of said first lateral walls and being positioned on opposite sides of said dividing wall, each of said second ends of said handles being attached to an outer surface of a second one of said lateral walls and being positioned on opposite sides of said dividing wall.

5. A bucket assembly comprising:

a housing having a bottom wall and a peripheral wall being attached to and extending upwardly from said bottom wall, said peripheral wall having an upper edge defining an opening into an interior of said housing;

a dividing wall being positioned in said housing and dividing said interior into a first section and a second section, said dividing wall being attached to said bottom wall, said dividing wall has a top edge, said top edge being positioned above said upper edge of said peripheral wall; and at least one handle being pivotally coupled to said housing;

a top wall is attached to said top edge of said dividing wall, said top wall extending partially over each of said first and second sections, a pair of side walls extending between said top wall and said upper edge of said peripheral wall, said side walls and said top wall defining hoods of each of said first and second sections.

6. The assembly according to claim 5, wherein said bottom wall has an oval shape, said peripheral wall including a pair of end walls and a pair of lateral walls, said lateral walls being longer than said end walls, said dividing wall extending between and being attached to said lateral walls.

7. The assembly according to claim 6, wherein said peripheral wall flares outwardly from said bottom wall to said upper edge.

8. The assembly according to claim 6, wherein said end walls flare away from said dividing wall.

9. The assembly according to claim 6, wherein said at least one handle includes a pair of handles, each of said handles being pivotally coupled to said housing, one of said handles being attached to said first section and one of said handles being attached to said second section, each of said handles including a first end and a second end, each of said handles being approximately U-shaped, each of said first ends of said handles being attached to an outer surface of a first of said lateral walls and being positioned on opposite sides of said dividing wall, each of said second ends of said handles being attached to an outer surface of a second one of said lateral walls and being positioned on opposite sides of said dividing wall.

* * * * *